US008555800B2

(12) United States Patent
Stasieluk

(10) Patent No.: US 8,555,800 B2
(45) Date of Patent: Oct. 15, 2013

(54) BOAT TILLER PRESENTMENT

(75) Inventor: John Edward Stasieluk, Edina, MN (US)

(73) Assignee: John Edward Stasieluk, Edina, MN (US)

( * ) Notice: Subject to any disclaimer, the term of this patent is extended or adjusted under 35 U.S.C. 154(b) by 345 days.

(21) Appl. No.: 12/961,468

(22) Filed: Dec. 6, 2010

(65) Prior Publication Data

US 2011/0132247 A1 Jun. 9, 2011

Related U.S. Application Data

(60) Provisional application No. 61/267,037, filed on Dec. 5, 2009.

(51) Int. Cl.

| | |
|---|---|
| ***B63H 25/02*** | (2006.01) |
| ***B63H 25/08*** | (2006.01) |
| ***B60R 11/02*** | (2006.01) |
| ***G01C 21/00*** | (2006.01) |
| ***G05G 1/04*** | (2006.01) |

(52) U.S. Cl.

USPC ..... 114/144 R; 114/162; 440/2; 440/63; 74/480 B

(58) Field of Classification Search

USPC ..... 114/144 R, 146, 218; 440/2, 6, 63–65; 74/480 B; 701/21

See application file for complete search history.

(56) References Cited

U.S. PATENT DOCUMENTS

| | | | | |
|---|---|---|---|---|
| 4,080,918 | A * | 3/1978 | Bonhard | 114/172 |
| 4,480,571 | A * | 11/1984 | Meyer | 114/146 |
| 4,907,521 | A * | 3/1990 | Kresse | 114/162 |
| 5,919,067 | A * | 7/1999 | Smith | 440/2 |
| 6,902,450 | B2 * | 6/2005 | Ohtsuki et al. | 440/63 |
| 2010/0131131 | A1 * | 5/2010 | Kamio et al. | 701/21 |

OTHER PUBLICATIONS

"GPS on the Tiller"—Catalina Association Forum, posted Jul. 8, 2008.*

"GPS Mounted on Tiller"—Trailer Sailor Forum, posted Feb. 6, 2004.*

* cited by examiner

*Primary Examiner* — Ajay Vasudeva

(74) *Attorney, Agent, or Firm* — Mitchell K. McCarthy; McCarthy Law Group

(57) ABSTRACT

An apparatus and associated method relating to a tiller for steering a boat. The tiller has an elongated body proximally connected to a steering mechanism portion of the boat and cantilevered therefrom, terminating at a distal end that is ergonomically responsive to a sailor's manual steering of the boat. The tiller also has a navigational device, such as GPS, mounted to the body and thereby operably presented to the sailor at a desired viewing angle to facilitate the sailor reading an output display of the navigational device while steering the boat.

9 Claims, 8 Drawing Sheets

BOAT TILLER PRESENTMENT

RELATED APPLICATIONS

This application claims the benefit of the earlier filing date of U.S. provisional patent application Ser. No. 61/267,037.

BACKGROUND

The present embodiments relate generally to boats, and more particularly as discussed herein but without limitation to tillers used in boats such as sailboats and iceboats. Both sailboats and iceboats operate by harnessing wind and are thereby propelled upon the water or ice, respectively. A sailor steers both kinds of boats by controlling a tiller that is connected to a steering member, such as a rudder in a sailboat, or runners (sometimes called skates or skis) in an iceboat. In both cases the tiller is connected to a steering post which, in turn, is connected to the steering member. Typically, the tiller in a sailboat is situated between the sailor and the stern (rear end) of the sailboat. Typically, the tiller in an iceboat is situated between the sailor and the bow (front end) of an iceboat, although stern-steering iceboats exist as well.

The sailor must have the necessary skills and ability to control a number of operational parameters to navigate a course at a desired direction and a desired speed. Some inherent characteristics of boating, such as in but not necessarily limited to competitive boating, subjects those skills and ability to heightened scrutiny, making it advantageous for the sailor to seek out and apply methodologies and technologies that aid in navigating the designated course. The ability to collect, store, and recall navigational information in a meaningful and useful way along the course is illustrative of the types of methodologies and technologies being pursued. It is to improvements in those methodologies and technologies that the claimed embodiments are directed.

SUMMARY

In some embodiments a tiller apparatus for steering a boat is provided. The tiller apparatus has an elongated body defining a first mounting configuration at a proximal end thereof that is sized to be operably attachable to a steering mechanism portion of the boat. The tiller apparatus also has a distal end that is configured to be ergonomically responsive to a sailor's manual steering of the boat. The tiller apparatus further has a second mounting configuration, medially disposed between the proximal and distal ends, that is sized to directly support a navigational device to aid the sailor in steering the boat along a desired course.

In some embodiments a tiller is provided for steering a boat. The tiller has an elongated body proximally connected to a steering mechanism portion of the boat and cantilevered therefrom, terminating at a distal end that is ergonomically responsive to a sailor's manual steering of the boat. The tiller also has a navigational device mounted to the body and thereby operably presented to the sailor at a desired viewing angle to facilitate the sailor reading an output display of the navigational device while steering the boat.

In some embodiments a method is provided that includes steps of obtaining a boat tiller having an elongated body; connecting a proximal end of the boat tiller to a steering mechanism portion of a boat; placing a navigational device in a recessed portion of a mounting configuration at an upstanding viewing angle that presents an output display of the navigational device to a sailor of the boat; and after the placing step, moving the mounting configuration from an unlatched position to a latched position to affix the navigational device to the boat tiller at the upstanding viewing angle.

DETAILED DESCRIPTION

Figure 1:
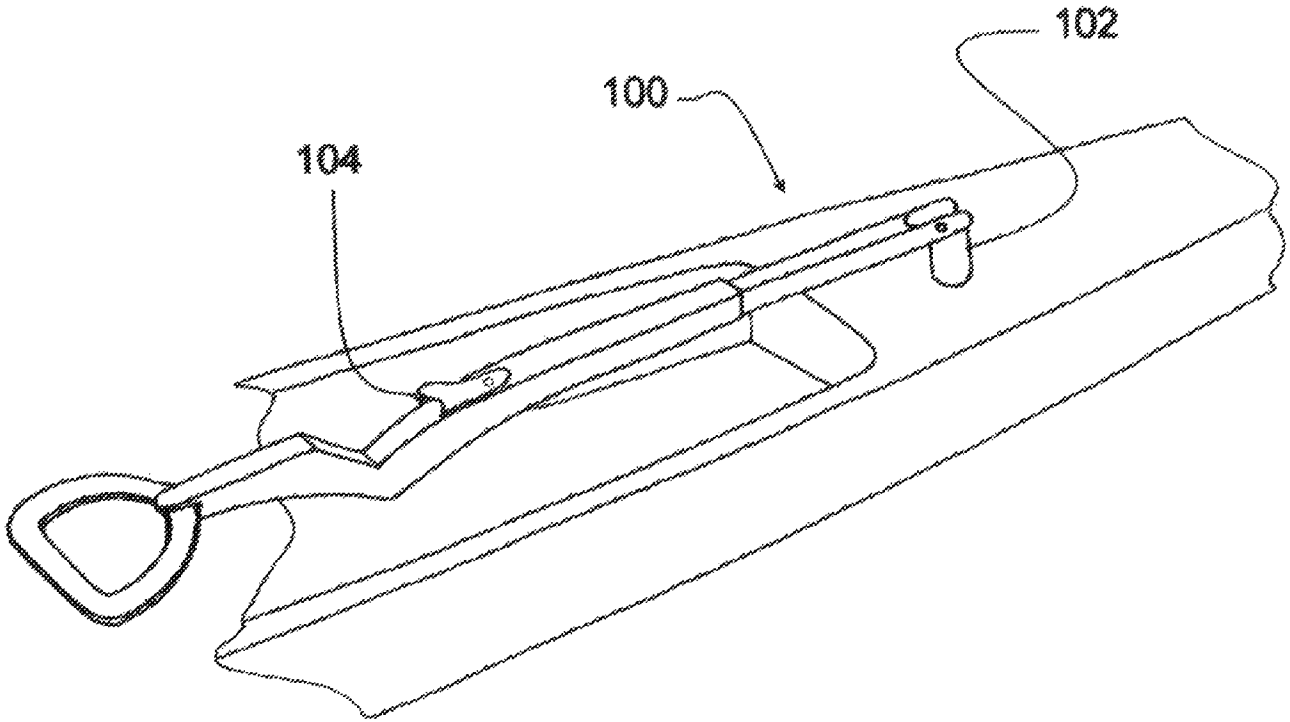
FIG. 1 is an isometric depiction of a portion of an iceboat that is constructed according to the present embodiments.

FIG. 1 is a partial, isometric depiction of an iceboat 100 that includes a steering post 102 that is, in turn, connected to front runners (not shown) which are steered to guide the iceboat 100. A tiller 104 is connected to the steering post 102. By rotating the tiller 104 about the steering post 102, the steering post 102 rotates, which in turn rotates the front runner (not shown). Therefore, in use, rotating the tiller 104 around the steering post 102 steers the iceboat 100.

Figure 2:
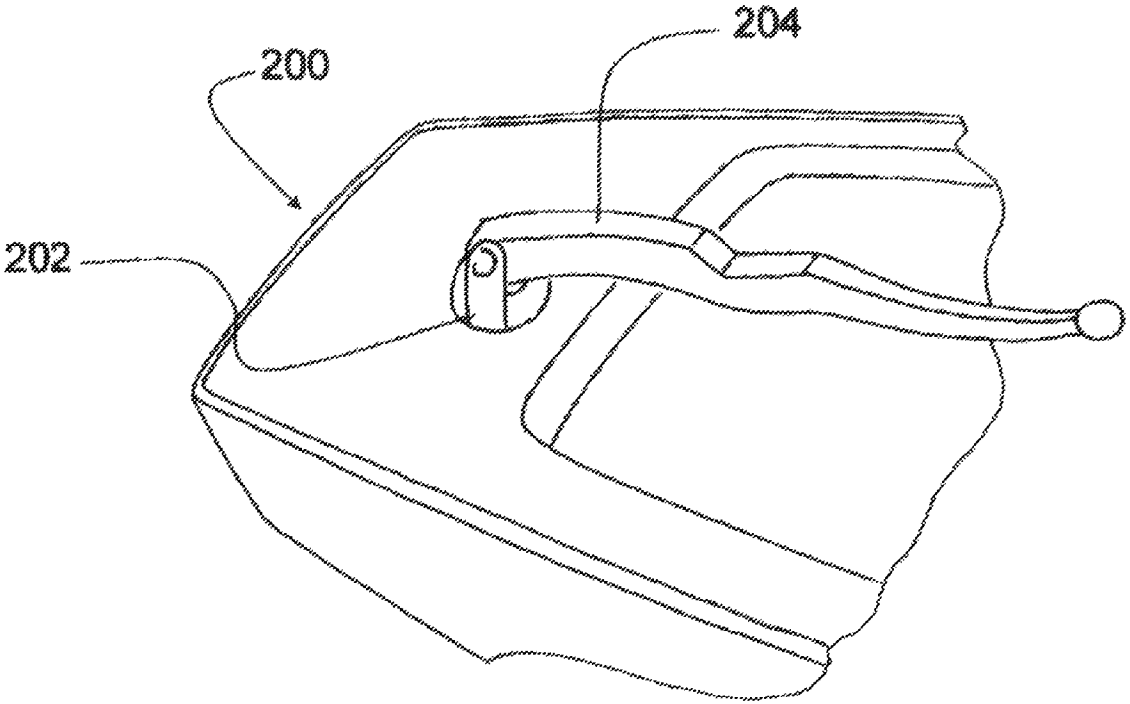
FIG. 2 is an isometric depiction of a portion of a sailboat that is constructed according to the present embodiments.

FIG. 2 similarly is a partial, isometric depiction of a sailboat 200 that includes a steering post 202 and a tiller 204 connected to the steering post 202. Rotating the tiller 204 rotates the steering post 202, which in turn rotates a rudder (not shown). Therefore, in use, rotating the tiller 204 steers the sailboat 200.

Figure 3:
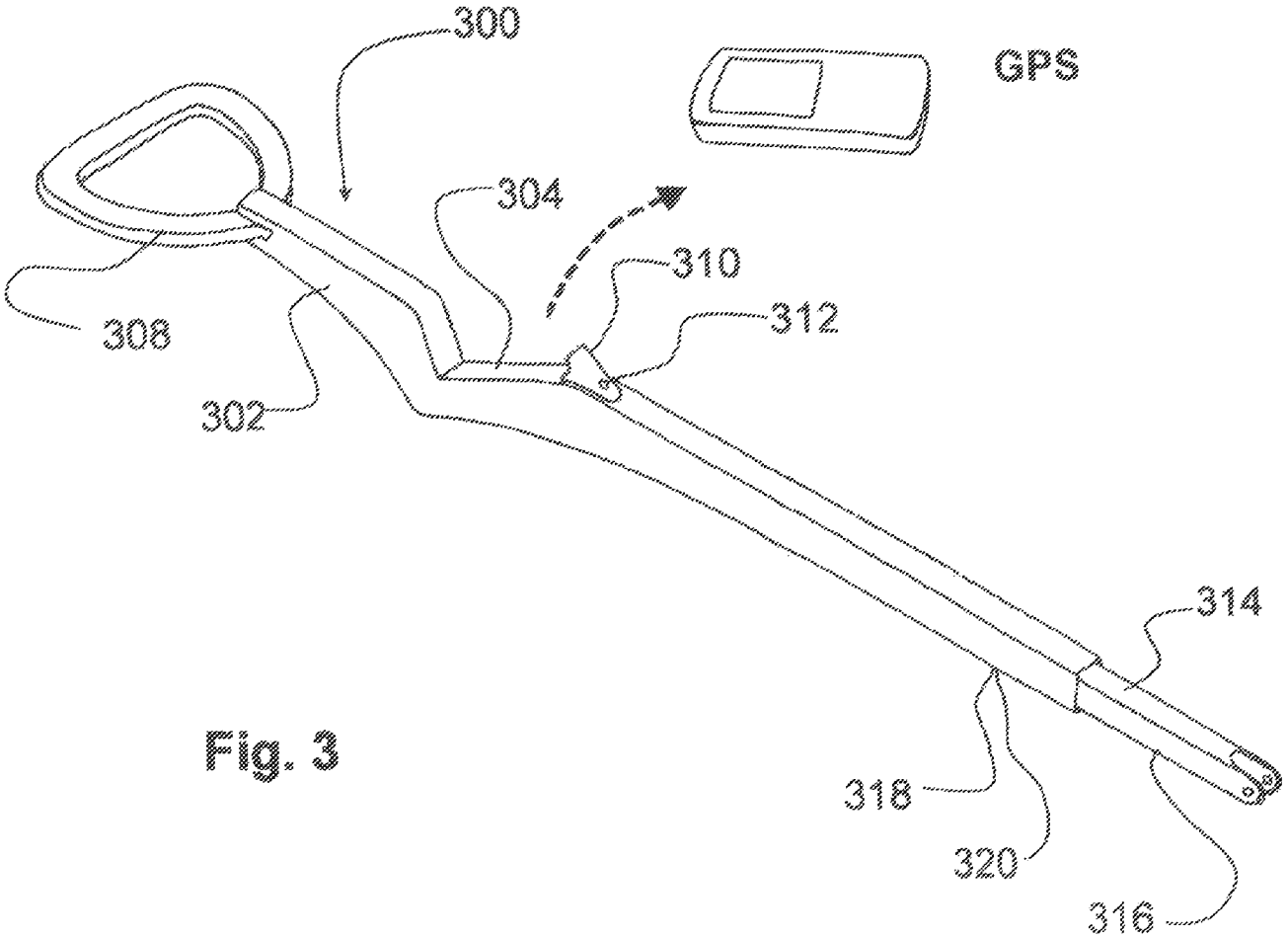
FIG. 3 is an enlarged isometric depiction of the tiller in FIG. 1.

FIG. 3 is an isometric depiction of a tiller 300. The tiller 300 has an elongated body 302 defining a mounting configuration at a proximal end thereof that is sized to be operably attachable to the steering mechanism of the boat, such as the steering post 102. A distal end of the body 302 terminates in an arrangement designed to be ergonomically responsive to the sailor's hand in manually steering the tiller 300. In these illustrative embodiments the distal end is configured to have a handle 308 defining a central opening (such as the D-shaped handle shown) through which the sailor can their gloved fingers to grip the tiller 300.

Another mounting configuration, medially disposed between the proximal and distal ends, is sized to directly support a navigational device (see below) to aid the sailor is steering the boat along a desired course. In the illustrative embodiments of FIG. 3 the medial mounting configuration is a recessed portion 304 that is defined by a surface of the body 302, although the claimed embodiments are not so limited.

The medial mounting configuration also includes a retainer mechanism that is selectively moveable between an unlatched position, whereby the navigational device is removably insertable in the recessed portion 304, and a latched position, whereby the navigational device is securely affixed to the body 302 in the recessed portion 304. For example, in these illustrative embodiments the retainer mechanism is a retainer clip 310 that is selectively attachable to the body 302 via a removable and replaceable retainer clip fastener 312.

As shown in FIG. 3, the recessed portion 304 is a notch-like indent in the body 302. The recessed portion 304 of the body 302 is shaped to allow for a navigational device (not shown) to be mounted to the body 302. The navigational device is an information appliance that focuses on handling a particular type of information and related tasks. A navigational device can include, but is not limited to, global positioning systems (GPS), cell phones, smart phones, speedometers, altimeters, communications systems, etc. Navigational devices can record trip information, provide course tracking, perform data collection and storage, provide trip comparisons, allow communications between the sailor and others, etc.

The navigational device can be mounted in the recessed portion 304 to allow the sailor to see an output display screen of the navigational device from the steering position. The shape of the recessed portion 304 can vary to accommodate different navigational devices. In other embodiments, the navigational device can be mounted to the body 302 by mounting the navigational device to a support structure (FIG. 7) that is fastened to the body 302. It is contemplated that the navigational device can be retained in the recessed portion 304 in any manner so long as the navigational device is mounted such that the sailor can collect data of view the output display on the navigational device.

The retainer clip 310 is fastened to the body 302 by a retainer clip fastener 312. The retainer clip 310 is positioned to secure the navigational device to the body 302 without obstructing the view of the output display screen of the navigational device. The retainer clip 310 secures the navigational device by holding the navigational device against the body 302 and can be rotated or moved in and out of a securing position. To accommodate different-sized navigational devices, the retainer clip 310 can be of any suitable configuration.

As shown in FIG. 3, the handle 308 is located on a distal end of the body 302 of the tiller 300. The opposite end of the body 302 is hollow to telescopingly engage the shaft 314. That is, the shaft 314 can selectively slide within the body 302 to extend or shorten the span between the proximal and distal ends, or in other words to lengthen or shorten the effective length of the tiller 300, allowing the sailor to adjust the position of the tiller and the navigational device based on an optimal alignment with her line of vision while steering the boat. The shaft 314 has an aperture 316 (shown as a slot in FIG. 6) that receivingly engages a shaft fastener 318. The aperture 316 does not necessarily extend the entire length of the shaft 314. As a result, when the shaft fastener 318 extends into the aperture 316, the shaft fastener 318 retains the shaft 314 from completely sliding out of the body 302, thereby avoiding a separation of the body 302 and the shaft 314. The shaft fastener 318 engages with a fastener receiver 320, which is embedded in the body 302. In use, the tiller 300 can be lengthened during low speed maneuvering and then shortened when up to speed. Alternatively, the shaft 314 can be affixed in the body 302 to provide a fixed, non-adjustable length.

The body 302 can be of any desired material including but not limited to wood, metal, and plastic. Similarly, the shaft 314 can be of any desired material including but not limited to wood, metal, and plastic. The shaft 314 and the body 302 do not have to be the same material.

Figure 4:
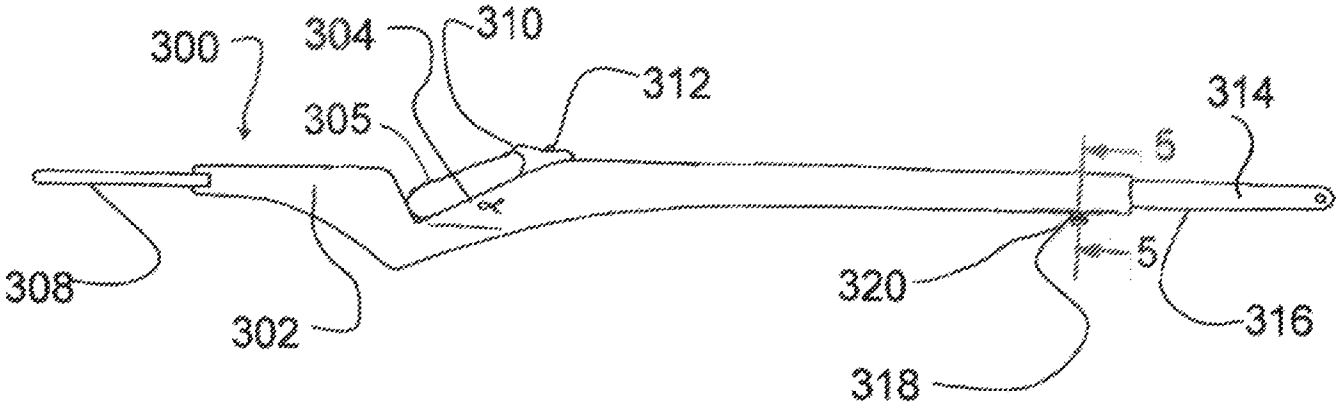
FIG. 4 depicts a side view of the tiller of FIG. 3.

As shown in FIG. 4, the recessed portion 304 is defined by a surface of the tiller 300 that supports the navigational device 305 in a plane that is non-parallel to a longitudinal axis of the tiller 300. That presents the navigational device 305 to the sailor at an advantageous upstanding viewing angle $\alpha$, which can be varied to accommodate different steering positions. The viewing angle can be selected to optimize the visibility of the output display of the navigational device 305 to the sailor. Varying the viewing angle $\alpha$ varies the shape of the recessed portion 304 in these illustrative embodiments.

Figure 5:
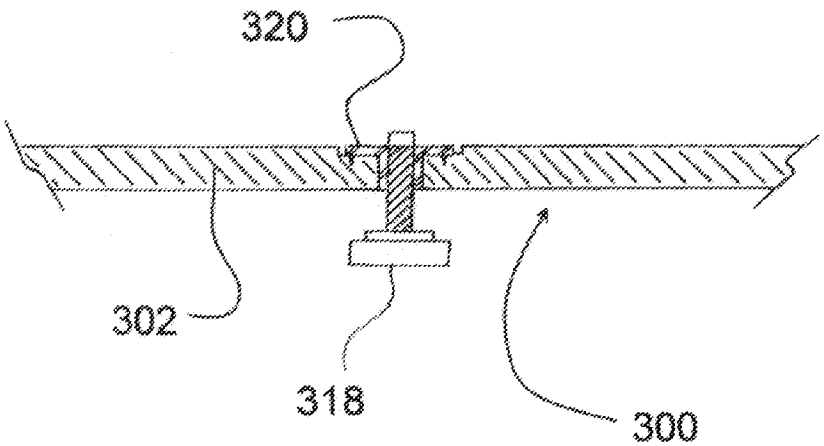
FIG. 5 is a cross-sectional depiction taken along line 5-5 of FIG. 4.
Figure 6:
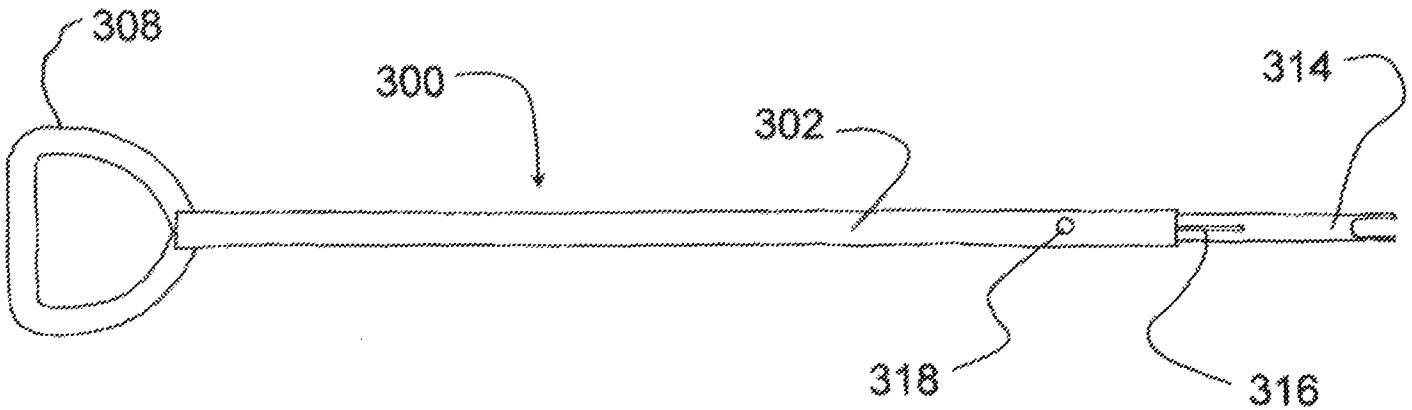
FIG. 6 depicts a bottom view of the tiller of FIG. 3.

As shown in FIG. 5, the body 302 of the tiller 300 has an embedded fastener receiver 320 to receivingly engage the shaft fastener 318. As shown in FIG. 6, the shaft 314 has an aperture 316 that receivingly engages the shaft fastener 318.

Figure 7:
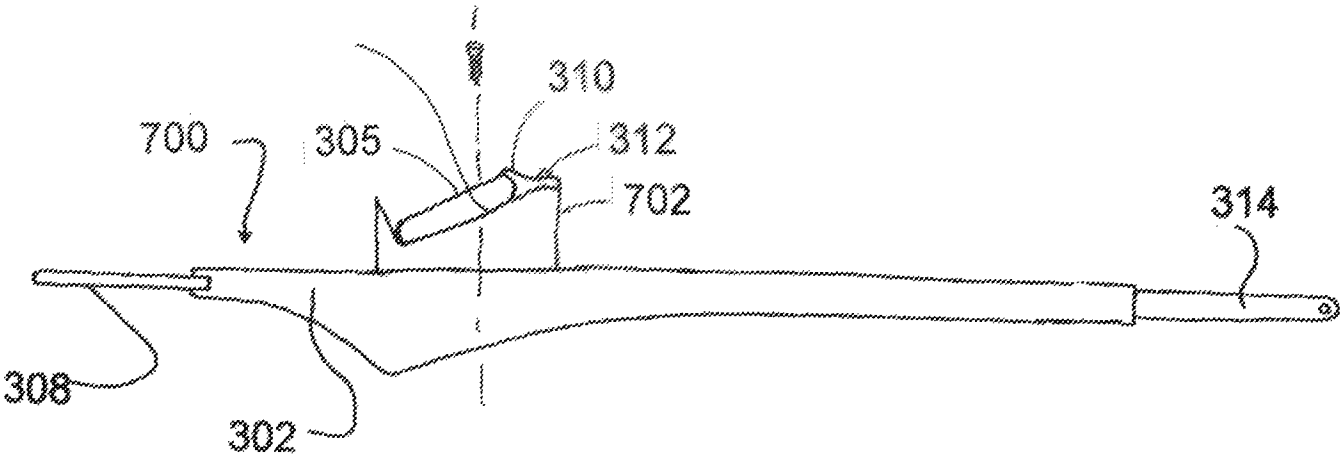
FIG. 7 depicts a side view similar to FIG. 3 but of a tiller that is constructed in accordance with alternative embodiments of the present invention.
Figure 8:
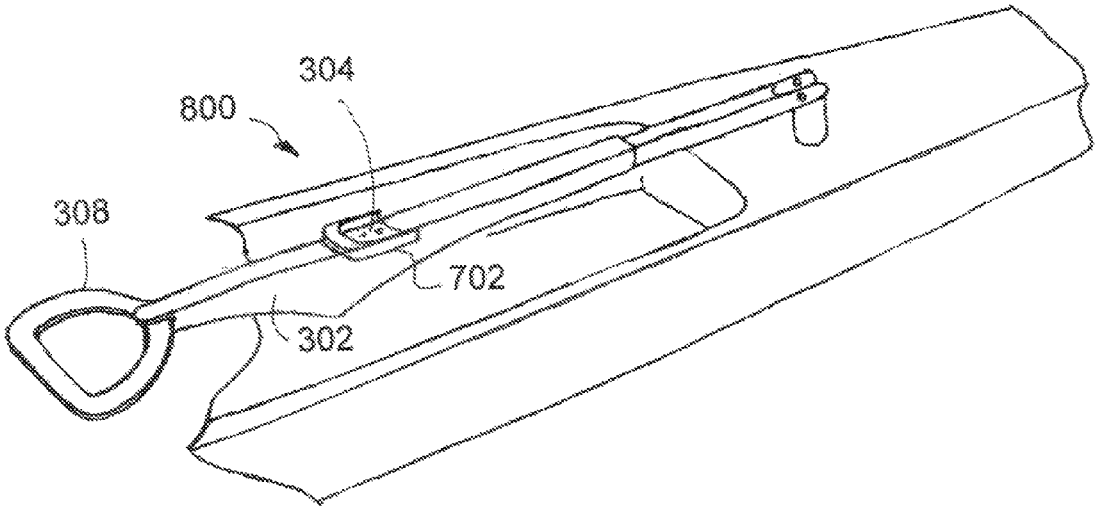
FIG. 8 depicts a partial isometric view of another tiller that is constructed in accordance with alternative embodiments of the present invention.

FIG. 7 depicts a side view of a tiller 700 that is constructed in accordance with alternative embodiments of the present invention. Instead of the body 302 defining the recessed portion 304, in these embodiments the mounting configuration includes a mounting bracket 702 defining the recessed portion 304. The mounting bracket 702 can be permanently affixed to the body 302, such as by adhering it, or as in these illustrative embodiments it can be removably attached to the body 302 by a replaceable fastener 704. FIG. 8 depicts a partial isometric view similar to FIG. 1 but of another tiller 800 that is constructed, more like FIG. 7, in accordance with alternative equivalent embodiments of the present invention. Like in FIG. 7, the medially disposed mounting configuration is attached to the body 302 instead of formed by it. Here, however, instead of a selectively movable retaining mechanism, the medially disposed mounting configuration is constructed of a mounting bracket that is shaped so that the navigational device is receivingly engaged into the recessed portion 304 in a close mating engagement and is thereby retained by the frictional engagement between the navigational device and the mounting bracket.

It is to be understood that even though numerous characteristics and advantages of various embodiments of the present invention have been set forth in the foregoing description, together with details of the structure and function of various embodiments of the invention, this detailed description is illustrative only, and changes may be made in detail, especially in matters of structure and arrangements of parts within the principles of the present invention to the full extent indicated by the broad general meaning of the terms in which the appended claims are expressed. For example, the particular elements may vary in type or arrangement without departing from the spirit and scope of the present invention.

In addition, although the embodiment described herein are described in relation to a tiller for sailboats and iceboats, it will be appreciated by those skilled in the art that the claimed subject matter is not so limited and various other systems can utilize that which is disclosed herein without departing from the spirit and scope of the embodiments of the present invention.

What is claimed is:

1. A tiller for steering a boat, the tiller comprising:

an elongated body having proximal and distal ends and a substantially planar upper surface extending between the proximal and distal ends, the elongated body connected at the proximal end to a steering mechanism portion of the boat and cantilevered therefrom, the distal end configured to be ergonomically responsive to a sailor's manual steering of the boat;

the elongated body having an open recess with a substantially sloped surface defined in the upper surface between the proximal and distal ends; and a navigational device having an output display, the navigational device removably mounted in the recess via a mounting configuration between the proximal and distal ends, the sloped surface supporting the navigational device at a substantially slanting angle to facilitate easy visual reading of the output display by the sailor while steering the boat.

2. The tiller of claim 1, wherein navigational device is an electronic navigational device.

3. The tiller of claim 2, wherein the electronic navigational device is selected from a group consisting of global positioning system (GPS), cell phone, smart phone, speedometer, altimeter, and electronic communications system.

4. The tiller of claim 1, wherein the mounting configuration comprises a retainer mechanism that is selectively moveable between an unlatched position, whereby the navigational device is removably insertable in the recess, and a latched position, whereby the navigational device is securely affixed to the body in the recess.

5. The tiller of claim 4, wherein the retainer mechanism is attached to the elongated body with a removable and replaceable fastener.

6. The tiller of claim 1, wherein the body comprises an adjustment mechanism for selectively adjusting a span between the proximal and distal ends.

7. The tiller of claim 6, wherein the adjustment mechanism comprises a threaded fastener.

8. The tiller of claim 1, wherein the substantially slanting angle is non-parallel and non-orthogonal to the planar upper surface.

9. A method comprising steps of:

obtaining the tiller of claim 1;

connecting the proximal end of the tiller to the steering mechanism portion of the boat; and mounting the navigational device in the recess of the tiller to facilitate easy visual reading of the output display by the sailor while steering the boat.

* * * * *